United States Patent [19]

Gunter

[11] Patent Number: 4,861,069

[45] Date of Patent: Aug. 29, 1989

[54] ADJUSTABLE VEHICLE COUNTERWEIGHT DEVICE WITH CYLINDER POSITIONING MEANS

[76] Inventor: Willard C. Gunter, Rte. 2, Box 13, Sevierville, Tenn. 37862

[21] Appl. No.: 205,741

[22] Filed: Jun. 13, 1988

[51] Int. Cl.[4] ..... E02F 9/18

[52] U.S. Cl. ..... 280/758; 172/611; 212/196; 414/719

[58] Field of Search ..... 280/758, 757, 759, 405 R, 280/405 A, 405 B; 212/195, 196; 172/611; 414/719, 673

[56] References Cited

U.S. PATENT DOCUMENTS

| | | | |
|---|---|---|---|
| 1,954,409 | 4/1934 | Hanel | 280/758 |
| 2,582,628 | 1/1952 | Halloran | 280/758 |
| 4,299,530 | 11/1981 | Schaeff | 280/758 |
| 4,502,709 | 3/1985 | Schaeff | 280/758 |

*Primary Examiner*—Richard A. Bertsch
*Attorney, Agent, or Firm*—Pitts and Brittian

[57] ABSTRACT

An adjustable vehicle counterweight device (10) with cylinder positioning means (62). The vehicle counterweight device (10) comprises a frame (16) for being secured to a motor vehicle, such as a tractor (12), and comprises a weight member (14) reciprocatably supported by the frame (16) such that the weight member (14) is laterally reciprocatable and selectively positionable along a path of travel substantially parallel to the axis of the axle (13) of the tractor so as to allow the selective alteration of the center of gravity of the tractor (12). The device (10) also includes means for selectively moving the weight member (14) along its path of travel, which, in the preferred embodiment, comprises a hydraulic cylinder (22) provided with cylinder positioning means (62) for adjusting the axial position of the cylinder portion (24) of the hydraulic cylinder (22) to alter the range of travel of the weight member (14).

10 Claims, 5 Drawing Sheets

FIG. 5
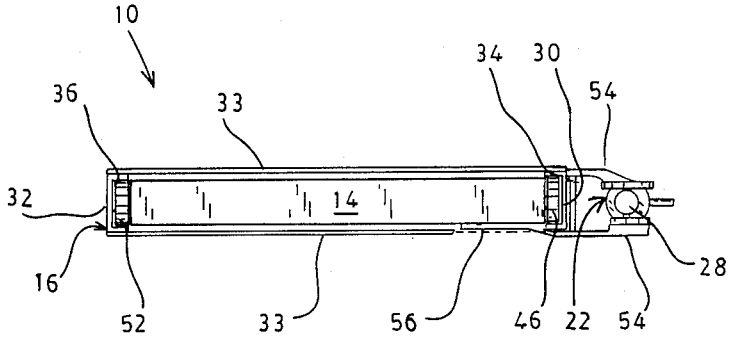
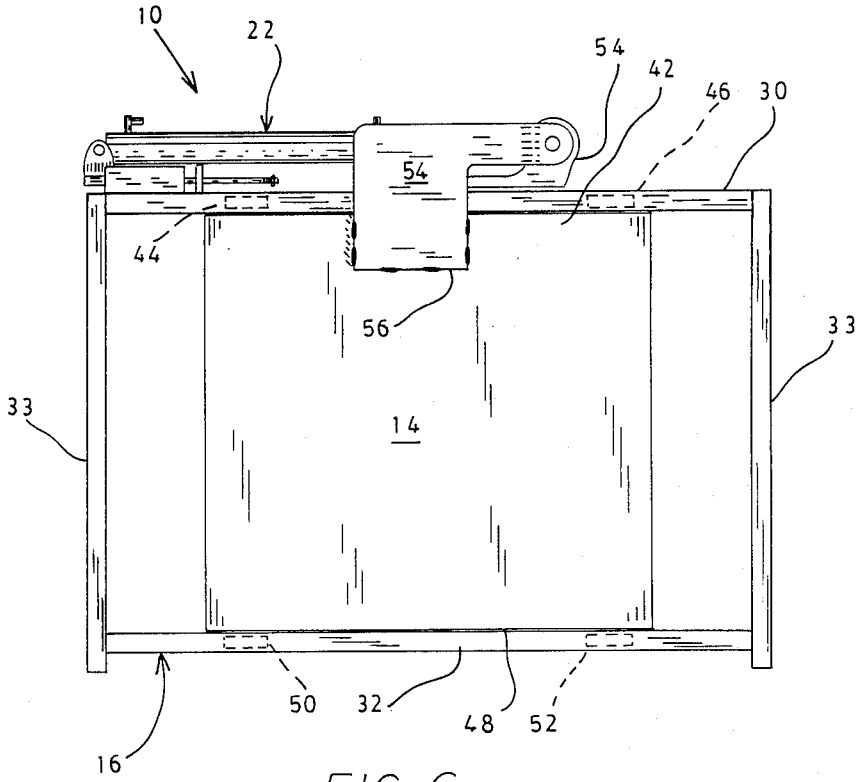
FIG. 6

ADJUSTABLE VEHICLE COUNTERWEIGHT DEVICE WITH CYLINDER POSITIONING MEANS

DESCRIPTION

1. Technical Field

This invention relates to a counterweight device for selective shifting of the center of gravity of a motor vehicle to prevent such vehicle from turning over or losing traction when operated on a sloped surface. In this particular invention, the device includes a weight member reciprocatably mounted on a frame.

2. Background Art

Tractors and other off-road vehicles are often required to operate on steep terrain. However, operation of a vehicle on a sloped surface can be dangerous due to the tendency of the vehicle to roll over or slide when the angle of the slope becomes too great. Certain devices have been designed to stabilize a vehicle when moving up or down a slope, such as the devices disclosed in U.S. Pat. No. 4,453,739 and French Patent No. 1.285.451. However, the danger of operating a vehicle on a slope can be particularly acute when the vehicle is following the contours of the slope and the normal center of gravity of the vehicle no longer serves to hold the uphill wheels of the vehicle on the surface.

Therefore, it is an object of the present invention to provide an adjustable vehicle counterweight device for shifting the center of gravity of a vehicle to facilitate the safe operation of such vehicle on a sloped surface, and to prohibit such vehicle from over-turning.

A further object of the present invention is to provide an adjustable vehicle counterweight device for improving wheel traction on a vehicle being operated on a sloped surface.

Yet another object of the present invention is to provide an adjustable vehicle counterweight device which allows a vehicle to operate safely on steep slopes, otherwise inaccessible to vehicles.

Still a further object of the present invention is to provide an adjustable vehicle counterweight device which is inexpensive to manufacture and maintain.

DISCLOSURE OF THE INVENTION

Other objects and advantages will be accomplished by the present invention which provides an adjustable vehicle counterweight device with cylinder positioning means. The vehicle counterweight device allows the center of gravity of a vehicle, such as a tractor, to be selectively altered to facilitate the operation of the vehicle on contoured surfaces. The device comprises a frame for securing to the vehicle and a weight member reciprocatably supported by the frame such that the weight member is selectively positionable along a path of travel substantially parallel to the axis of the axle of the vehicle. Accordingly, the weight member can be selectively shifted from one side of the vehicle to the other to shift the center of gravity of the vehicle. Means are also provided for selectively moving the weight member along the path of travel which, in the preferred embodiment, comprises a hydraulic cylinder provided with cylinder positioning means for adjusting the axial position of the cylinder portion of the hydraulic cylinder to alter the range of travel of the weight member.

BRIEF DESCRIPTION OF THE DRAWINGS

The above-mentioned features of the present invention will become more clearly understood from the following detailed description of the invention read together with the drawings in which:

FIG. 5 illustrates a left side elevation of a counterweight device of the present invention;

FIG. 6 illustrates a bottom view of a vehicle counterweight device of the present invention;

BEST MODE FOR CARRYING OUT THE INVENTION

Figure 1:
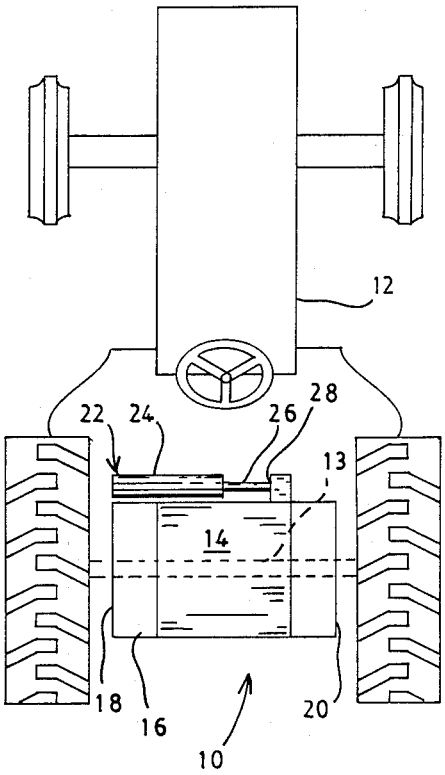
FIG. 1 illustrates a diagrammatic top view of a vehicle counterweight device of the present invention.

An adjustable vehicle counterweight device incorporating various features of the present invention is illustrated generally at 10 in the figures. As diagrammatically illustrated in FIGS. 1 through 3, the counterweight device 10 is designed to be secured to a tractor 12, or other vehicle, and generally comprises a weight member 14 movably mounted in a frame 16 such that the weight member 14 is laterally reciprocatable between a first position proximate a first end portion 18 of the frame 16 and a second position proximate a second end portion 20 of the frame 16. Preferably, the counterweight device 10 is mounted beneath the rear axle 13 of the tractor 12 such that the path of travel of the weight member 14 is substantially parallel to the axis of the axle 13.

The counterweight 10 further includes means for selectively moving the weight member 14 between the first position and the second position, which in the preferred embodiment comprises a conventional hydraulic cylinder 22. As will be understood by those skilled in the art, the hydraulic cylinder 22 includes a cylinder portion 24 housing a piston (not shown) which is selectively reciprocated in response to fluid, under pressure, being injected into the cylinder portion 24. The piston carries an actuator arm 26 which extends out of the cylinder portion 24, and reciprocates with the piston. As illustrated, the actuator arm 26 defines an outboard end 28 which is secured to the weight member 14 such that selective reciprocation of the arm 26 results in selective lateral movement of the weight member 14.

Figure 2:
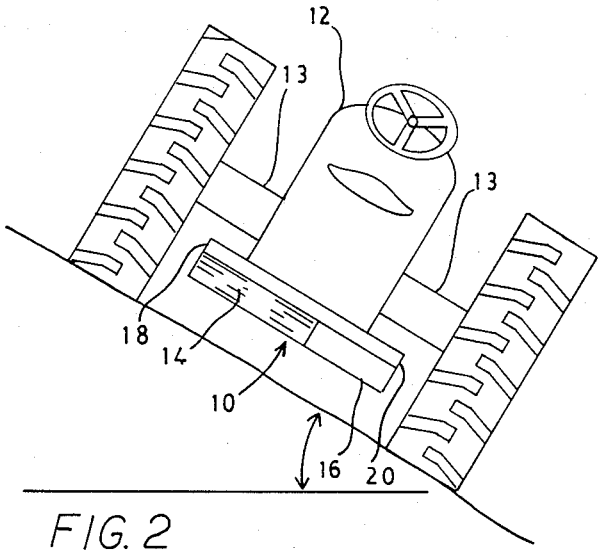
FIG. 2 illustrates a diagrammatic rear view of a vehicle counterweight device of the present invention.
Figure 3:
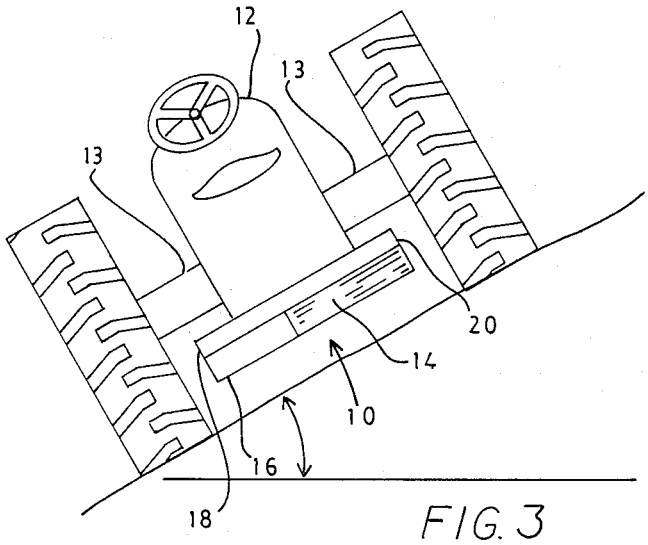
FIG. 3 illustrates a diagrammatic rear view of a vehicle counterweight device of the present invention.

With respect to the operation of the device 10, the counterweight device 10 is used to shift the center of gravity of the tractor 12, or other vehicle, to help stabilize the tractor 12 as the tractor travels with the contours of a sloped surface. For example, as illustrated in FIGS. 2 and 3, when the tractor 12 is moving across a slope, the hydraulic cylinder 22 is utilized to move the weight member 14 to the uphill side of the frame 16 thereby shifting the center of gravity of the tractor 12 to the uphill side of the tractor 12. This shift of the weight member 14 to the uphill side of the tractor 12 makes it less likely that the tractor 12 will flip over and increases the traction of the uphill wheels. Accordingly, the device 10 allows the tractor 12, or other vehicle, to travel along contours defining steeper grades without risk of turning over and without loss of traction on the uphill wheels.

Figure 4:
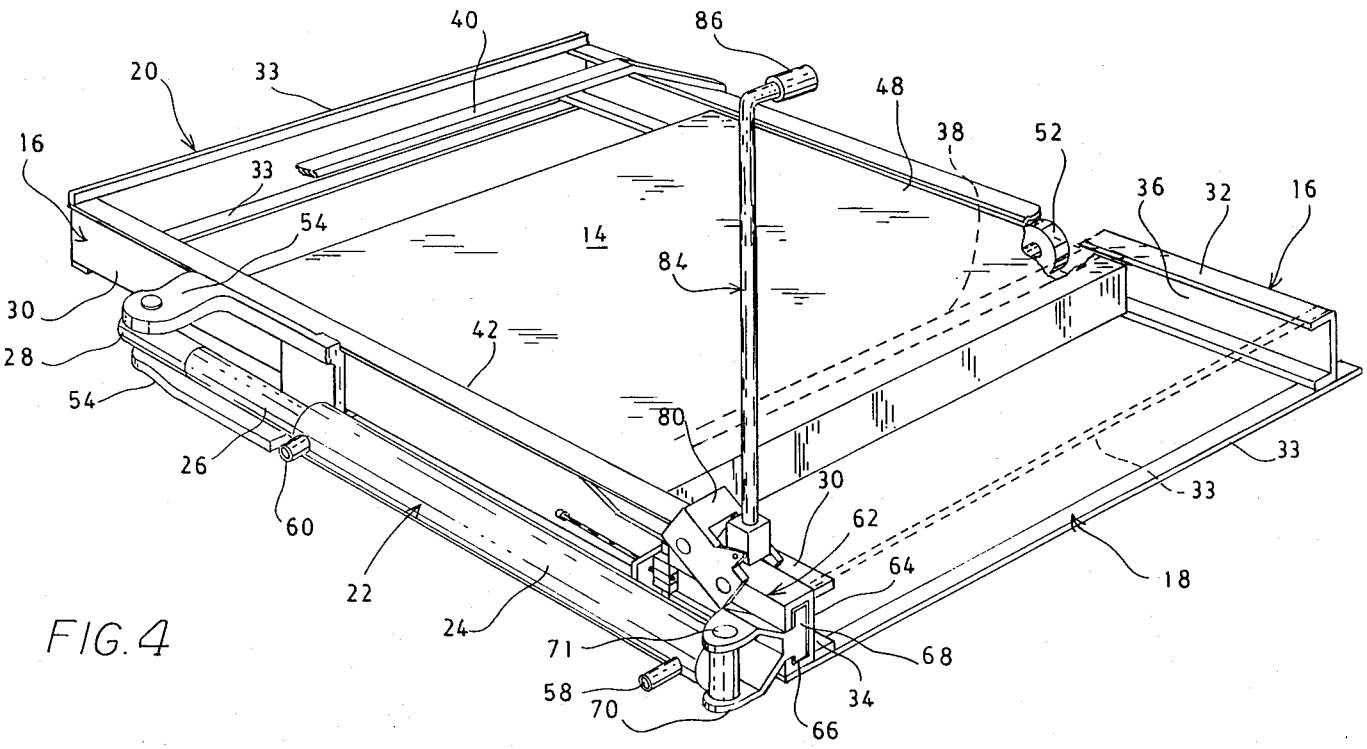
FIG. 4 illustrates a perspective view of a vehicle counterweight device of the present invention.

In FIGS. 4 through 6, a preferred embodiment of the counterweight device 10 is illustrated. As illustrated, the frame 16 comprises a pair of selectively spaced, oppositely disposed track members 30 and 32, secured together at their opposite end portions by a plurality of brace members 33, the track members 30 and 32 each including a lower support member 31 and an upper retainer member 33 so as to define the inwardly disposed travelways 34 and 36. Further, means are provided for securing the frame 16 to the tractor 12, which, in the preferred embodiment, comprises a pair of bracket members 38 and 40 which are secured at their opposite ends to the track members 30 and 32, and engage the chassis of the tractor 12. Of course, the bracket members 38 and 40 can be secured to the chassis of the tractor with various fasteners, such as bolts with nuts secured thereon, or can be welded to the chassis if desired.

Means are also provided for reciprocatably securing the weight member 14 to the track members 30 and 32, which, in the preferred embodiment, comprise a plurality of wheel members for being received in the travelways 34 and 36. More specifically, the weight member 14 defines a first side portion 42 on which are rotatably mounted a pair of first wheel members 44 and 46, and further defines a second side portion 48 rotatably carrying a pair of further wheel members 50 and 52. As illustrated, the wheel members 44 and 46 are received in the travelway 34 and the wheel members 50 and 52 are received in the travelway 36 with the wheel members being maintained between the support members 31 and the retainer members 33. Accordingly, the wheel members 44, 46, 50 and 52 rotatably support the weight member 14 in the frame 16 and allow the weight member 14 to reciprocate along the travelways 34 and 36. It will, however, be understood that other suitable means can be provided for reciprocatably securing the weight member 14 to the frame 16, and the wheel members 44, 46, 50 and 52 are simply illustrative of one preferred means.

As will be discussed further below, the cylinder portion 24 of the hydraulic cylinder 22 is secured to the first track member 30 of the frame 16. Further, the outboard end 28 of the actuator arm 26 is secured to a securing bracket 54, the bracket 54 being secured to the weight member 14 by a flange 56 which engages the undersurface of the weight member 14. Resultantly, selective reciprocation of the actuator arm 26 causes the weight member 14 to reciprocate along the track members 30 and 32. For example, as fluid is injected into the port 58 of the cylinder 22, the actuator arm 26 is extended, causing the weight to travel toward the second end portion 20 of the frame 16, and when fluid is injected into the further port 60, the actuator arm 26 is retracted and the weight member 14 is moved toward the first end portion 18 of the frame 16.

Figure 7:
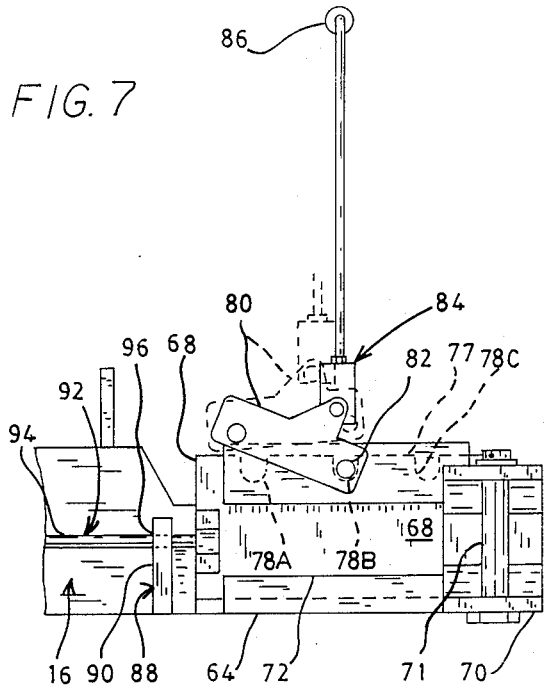
FIG. 7 illustrates a front view of the cylinder positioning means of the present invention.
Figure 8:
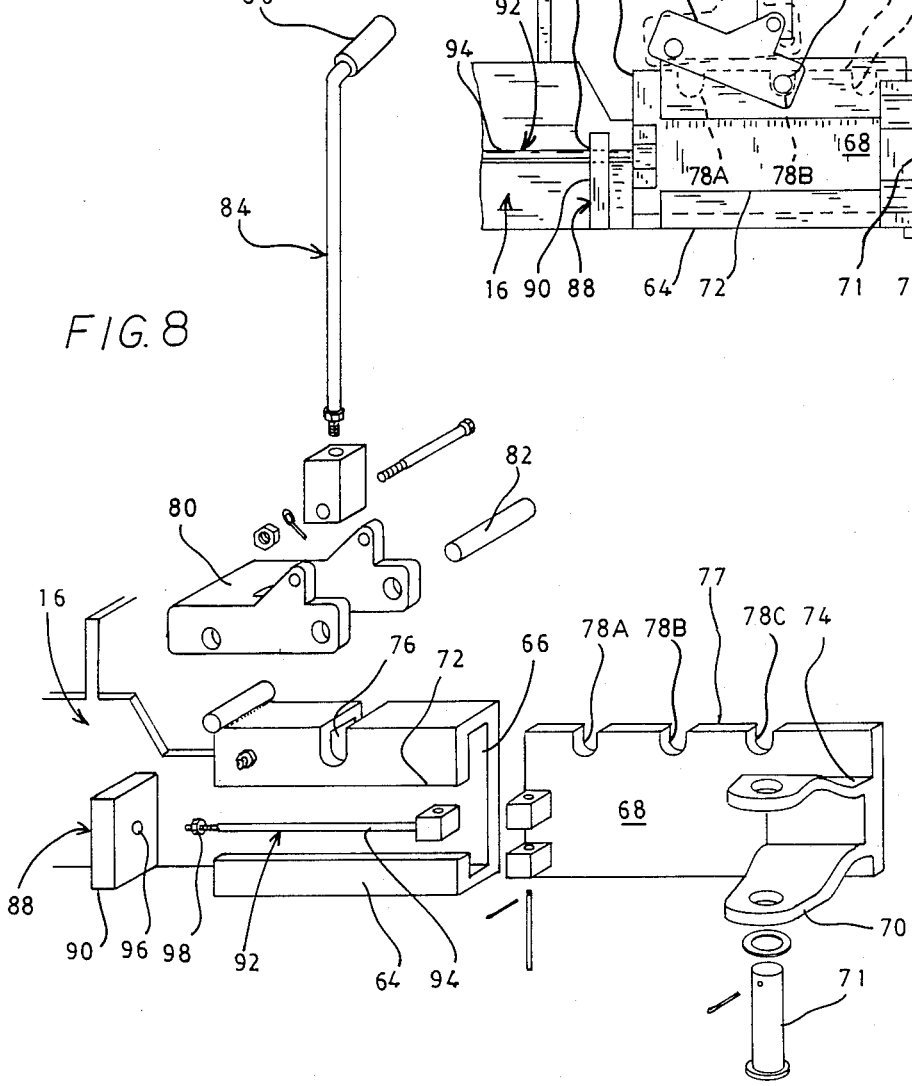
FIG. 8 illustrates an exploded perspective view of the cylinder positioning means of the present invention.

As indicated above, the cylinder portion 24 of the hydraulic cylinder 22 is secured to the frame 16. However, in the preferred embodiment, the device 10 is provided with cylinder positioning means, illustrated at 62 in the figures, for adjustably securing the cylinder portion 24 of the cylinder 22 to the frame 16. More specifically, the cylinder positioning means 62 allows the axial position of the cylinder portion 24 of the hydraulic cylinder 22 to be altered to, in turn, alter the range of travel of the weight member 14. As is best illustrated in FIGS. 6 and 7, the cylinder positioning means 62 comprises a channel bracket 64 provided on the frame 16. The channel bracket 64 defines a channel 66 which is slidably receptive of a cylinder mounting plate 68 for engaging the cylinder portion 24 of the hydraulic cylinder 22. In order to effect the securing of the cylinder portion 24 to the plate 68, the plate 68 is provided with a clevis 70 which engages the rearward portion of the cylinder portion 24 and is secured to the portion 24 with a suitable pin 71 or other fastener. It will be noted that the channel bracket 64 defines a forward disposed slot 72 which slidably receives the base portion 74 of the clevis 70 such that the clevis 70 extends outwardly from the bracket 64. Thus, the plate 68 serves to slidably secure the cylinder portion 24 to the frame 16 thereby allowing axial movement of the cylinder portion 24.

The cylinder positioning means 62 also includes locking means for selectively locking the axial position of the cylinder portion 24. In this regard, in the preferred embodiment, the upper portion of the bracket 64 is provided with an aperture 76, and the upper edge 77 of the plate 68 is provided with a plurality of selectively spaced notches 78A, 78B and 78C which can be made to register with the aperture 76 by selective positioning of the plate 68. A locking member 80 is pivotally mounted on the upper portion of the channel bracket 64 and carries a locking bar 82 which can be pivoted into the aperture 76 and into one of the notches 78A-B to lock the plate 68 in a preselected position in the bracket 64, thereby securing the axial position of the cylinder portion 24. Of course, to release the plate 68, the locking bar 82 is pivoted upwardly, out of the aperture 76. It will also be noted that to facilitate the locking and unlocking of the plate 68, a handle assembly 84 can be provided which engages the locking member 80 proximate the locking bar 82. Accordingly, the member 80 can be pivoted by raising and lowering the handle 86 of the assembly 84.

It will be appreciated by those skilled in the art that the cylinder positioning means 62 serves to extend the range of travel of the weight member 14. For example, when the locking bar 82 is positioned within the notch 78A, the weight member 14 will travel further in the direction of the second end portion 20 of the frame than when in the normal operating range associated with the notch 78B. Similarly, when the locking bar 82 is positioned within the notch 78C, the weight member 14 will travel further in the direction of the first end portion 18 of the frame than when in the notch 78B. Of course, this allows for a greater shift in the center of gravity of the tractor when unusually steep contours are encountered.

Those skilled in the art will also recognize that the necessary movement of the plate 68 to align a particular notch 78 with the aperture 76 can be provided by the hydraulic cylinder 22. In this regard, when the locking means is unlocked, the plate 68 slides freely in the channel 64 such that actuation of the cylinder 22 results in movement of the cylinder portion 24 and the plate 68 rather than movement of the weight member 14. Therefore, selective actuation of the cylinder 22 allows the locking bar 82 to be quickly moved from one notch 78 to another. Further, a stop mechanism can be provided to limit the travel of the plate 68 such that the plate 68 remains slidably secured within the channel bracket 64 during operation. In the preferred embodiment, such mechanism includes a first stop member 88 which comprises a flange 90 extending outwardly from the frame 16 so as to restrict the travel of the plate 68 in the direction of the second end portion 20 of the frame. Travel in the direction of the first end portion 18 of the frame 16 is limited by a second stop member 92 comprising a rod 94 secured to the plate 68. The rod 94 is slidably received through a hole 96 in the flange 90 and a nut 98 is secured on the outboard end of the rod 94 to slidably secure the rod 94 in the hole 96 such that the nut 98 serves as a stop to restrict travel of the rod 94, and, thus, the plate 68, in the direction of the first end portion 18 of the frame 16.

In light of the above, it will be appreciated that the vehicle counterweight device of the present invention allows a tractor, or other vehicle, to be operated safely on steeply contoured surfaces. Moreover, it reduces wheel slippage of the uphill drive wheel(s) of the vehicle providing better traction and, thus, more efficient operation. While a preferred embodiment has been shown and described, it will be understood that there is no intent to limit the invention to such disclosure, but, rather, it is intended to cover all modifications and alternate constructions falling within the spirit and scope of the invention as defined in the appended claims.

I claim:

1. An adjustable vehicle counterweight device for being mounted on a motor vehicle for selectively altering the center of gravity of said vehicle, said vehicle having at least one axle defining a rotational axis, said device comprising:

a frame for being secured to said motor vehicle, said frame having a first end portion and a second end portion, said frame including first and second selectively spaced track members, each said track member defining a travelway extending from said first end portion of said frame to said second end portion of said frame and aligned substantially parallel to said axis of said axle of said vehicle;

a weight member reciprocatably supported by said frame, said weight member defining a first side portion provided with at least a pair of rotatably mounted wheel members for being received in said travelway of said first track member and defining a second side portion provided with at least a pair of rotatably mounted wheel members for being received in said travelway of said second track member, whereby said weight member is reciprocatable between a first position proximate said first end portion of said frame and a second position proximate said second end portion of said frame;

a hydraulic cylinder for selectively reciprocating said weight member, said cylinder including a cylinder portion and a reciprocating actuator arm having a free end portion secured to said weight member; and cylinder positioning means for adjusting the axial position of said cylinder portion of said hydraulic cylinder, said means including a channel bracket for securing to said frame, said channel bracket defining a channel, and including a cylinder mounting plate for engaging said cylinder portion, and for being slidably received in said channel of said channel bracket, said cylinder positioning means being provided with locking means for releasably locking said plate in a selected position as said plate is slidably received by said channel bracket.

2. The vehicle counterweight device of claim 1 wherein said plate carries a clevis for engaging said cylinder portion, said clevis defining a base portion, and wherein said channel bracket defines an elongated slot accessing said channel for slidably receiving said base portion of said clevis whereby said clevis is allowed to extend out of said channel bracket to engage said cylinder portion.

3. The vehicle counterweight device of claim 2 wherein said channel bracket defines an aperture accessing said channel and said plate defines an upper edge portion provided with a plurality of selectively spaced notches, each said notch being registrable with said aperture upon selective positioning of said plate within said channel bracket, and wherein said locking means comprises a locking member pivotally secured to said channel bracket, said locking member including a locking bar for being pivoted into said aperture and one of said notches whereby said plate member is releasably locked in a preselected position in said channel bracket.

4. The vehicle counterweight device of claim 3 wherein said locking member carries a handle assembly for selectively pivoting said locking member.

5. An adjustable vehicle counterweight device for mounting on a motor vehicle, said vehicle having at last one axle defining a rotational axis, said device comprising:

a frame for securing to said motor vehicle, said frame including first and second selectively spaced track members, each said track member including a lower support member and an upper retainer member so as to define a travelway therebetween;

a weight member reciprocatably supported by said frame such that said weight member is reciprocatable and selectively positionable along a path of travel substantially parallel to said axis of said axle, said weight member having a first side portion carrying at least a pair of rotatably mounted wheel members for being rotatably received in said travelway of said first track member, and having a second side portion carrying at least a pair of said rotatably mounted wheel members for being rotatably received in said travelway of said second track member;

a hydraulic cylinder for selectively moving said weight member along said path of travel, said hydraulic cylinder including a cylinder portion and a reciprocating actuator arm having an outboard end portion secured to said weight member; and cylinder positioning means secured to said frame for securing said cylinder portion to said frame and for adjusting the axial position of said cylinder portion of said hydraulic cylinder, whereby the range of reciprocation of said weight member along said path of travel is selectively altered.

6. An adjustable vehicle counterweight device for mounting on a motor vehicle, said vehicle having at least one axle defining a rotational axis, said device comprising:

a frame for securing to said motor vehicle;

a weight member reciprocatably supported by said frame such that said weight member is reciprocatable and selectively positionable along a path of travel substantially parallel to said axis of said axle;

means for selectively moving said weight member along said path of travel including a hydraulic cylinder having a cylinder portion and a reciprocating actuator arm having an outboard end portion secured to said weight member; and cylinder positioning means for adjusting the axial position of said cylinder portion of said hydraulic cylinder, said positioning means including a channel bracket for securing to said frame, said channel bracket defining a channel and an elongated slot accessing said channel, and including a cylinder mounting plate for engaging said cylinder portion of said hydraulic cylinder and for being slidably received in said channel of said channel bracket, said plate being provided with a clevis for engaging said cylinder portion of said hydraulic cylinder, said clevis defining a base portion for being slidably receiving by said elongated slot of said channel bracket, whereby said clevis is allowed to extend out of said channel bracket to engage said cylinder portion, said positioning means further including locking means for releasably locking the position of said plate as said plate is slidably received by said channel bracket.

7. The vehicle counterweight device of claim 6 wherein said channel bracket defines an aperture accessing said channel and said plate defines an upper edge portion provided with a plurality of selectively spaced notches, each said notch being registrable with said aperture upon selective positioning of said plate within said channel bracket, and wherein said locking means comprises a locking member pivotally secured to said channel bracket, said locking member including a locking bar for being pivoted into said aperture and one of said notches whereby said plate member is releasably locked in a preselected position in said channel bracket.

8. The vehicle counterweight device of claim 6 wherein said locking member carries a handle assembly for selectively pivoting said locking member.

9. A cylinder positioning apparatus for mounting on a frame for selectively adjusting the axial position of the cylinder portions of a hydraulic cylinder, said apparatus comprising:

a channel bracket for securing to said frame, said channel bracket defining a channel and an elongated slot accessing said channel;

a cylinder mounting plate for engaging said cylinder portion of said hydraulic cylinder, and for being slidably received in said channel of said channel bracket, said plate being provided with a clevis for engaging said cylinder portion, said clevis defining a base portion for being slidably received in said slot of said channel bracket, whereby said clevis is allowed to extend out of said channel bracket to engage said cylinder portion; and locking means for releasably locking said plate in position as said plate is slidably received by said channel bracket.

10. A cylinder positioning apparatus for mounting on a frame of a vehicle counterweight device for selectively adjusting the axial position of the cylinder portions of a hydraulic cylinder, said apparatus comprising:

a channel bracket for securing to said frame, said channel bracket defining a channel and an aperture accessing said channel;

a cylinder mounting plate for engaging said cylinder portion of said hydraulic cylinder, and for being slidably received in said channel of said channel bracket, said plate being provided with a plurality of selectively spaced notches, each notch being registerable with said aperture of said channel bracket upon selective positioning of said plate within said channel bracket; and locking means for releasably locking said plate in position as said plate is slidably received by said channel bracket, said locking means including a locking member pivotally secured to said channel bracket, said locking member including a locking bar for being pivoted into said aperture and one of said notches whereby said plate member is releasably locked in a preselected position in said channel bracket.

* * * * *